United States Patent [19]

Demuth et al.

[11] Patent Number: 5,054,166

[45] Date of Patent: Oct. 8, 1991

[54] ADJUSTABLE TEXTILE CARD ELEMENT AND METHOD OF USE

[75] Inventors: Robert Demuth, Nürensdorf; Peter Fritzsche, Winterthur; René Waeber, Winterthur; Paul Stäheli, Wilen; Jürg Faas, Dinhard, all of Switzerland

[73] Assignee: Maschinenfabrik Rieter, AG, Winterthur, Switzerland

[21] Appl. No.: 540,777

[22] Filed: Jun. 20, 1990

[30] Foreign Application Priority Data

Jun. 21, 1989 [CH] Switzerland ..... 312/89

[51] Int. Cl.[5] ..... D01G 15/28

[52] U.S. Cl. ..... 19/113; 19/108

[58] Field of Search ..... 19/102–104, 19/108–114

[56] References Cited

U.S. PATENT DOCUMENTS

| | | | |
|---|---|---|---|
| 431,685 | 7/1890 | Canning | 19/104 |
| 2,933,772 | 4/1960 | Hattori et al. | 19/108 |
| 4,553,288 | 11/1985 | Schneider | 19/113 |

FOREIGN PATENT DOCUMENTS

| | | | |
|---|---|---|---|
| 66304 | 4/1892 | Fed. Rep. of Germany | 19/114 |
| 1106653 | 5/1961 | Fed. Rep. of Germany | 19/113 |
| 665892 | 9/1929 | France | 19/114 |
| 13491 | of 1851 | United Kingdom | 19/112 |
| 632268 | 11/1949 | United Kingdom | 19/110 |
| 861166 | 2/1961 | United Kingdom | 19/110 |

*Primary Examiner*—Werner H. Schroeder
*Assistant Examiner*—John J. Calvert
*Attorney, Agent, or Firm*—Burns, Doane, Swecker & Mathis

[57] ABSTRACT

A carding element (3) on the periphery of a carding or cleaning roller (1) is arranged to be movable in the direction toward or away from the roller (1) and is movable to selectively present different types or sizes of clothing elements (14.1, 14.2, 14.3 and 14.4) in proximity to the roller (1) so as to effect different actions on the fibers as the clothing elements on the carding element function as counter clothing elements for the clothing (12) of the carding or cleaning roller. This facilitates optimization of the cleaning function obtainable through the cooperation between the clothing (12) on the card drum and the clothing elements (14).

23 Claims, 9 Drawing Sheets

12
12
1
VI
V
38
36
40
32
40
37
3.2
6
43
35
42
45
23
8
8
35
25
24
9
9
10
20
40
32
32
39
40
10
21
7
V
5
7
11
VI

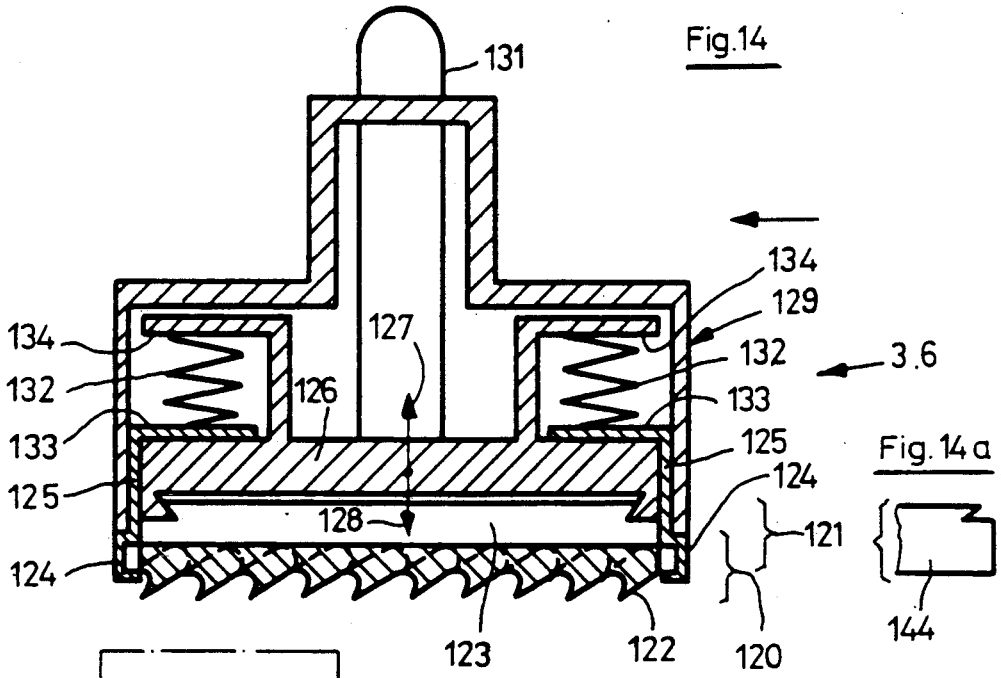
Fig.14
131
134
129
132
3.6
133
125
124
121
120
122
123
128
127
126
134
132
133
125
124
Fig. 14a
144
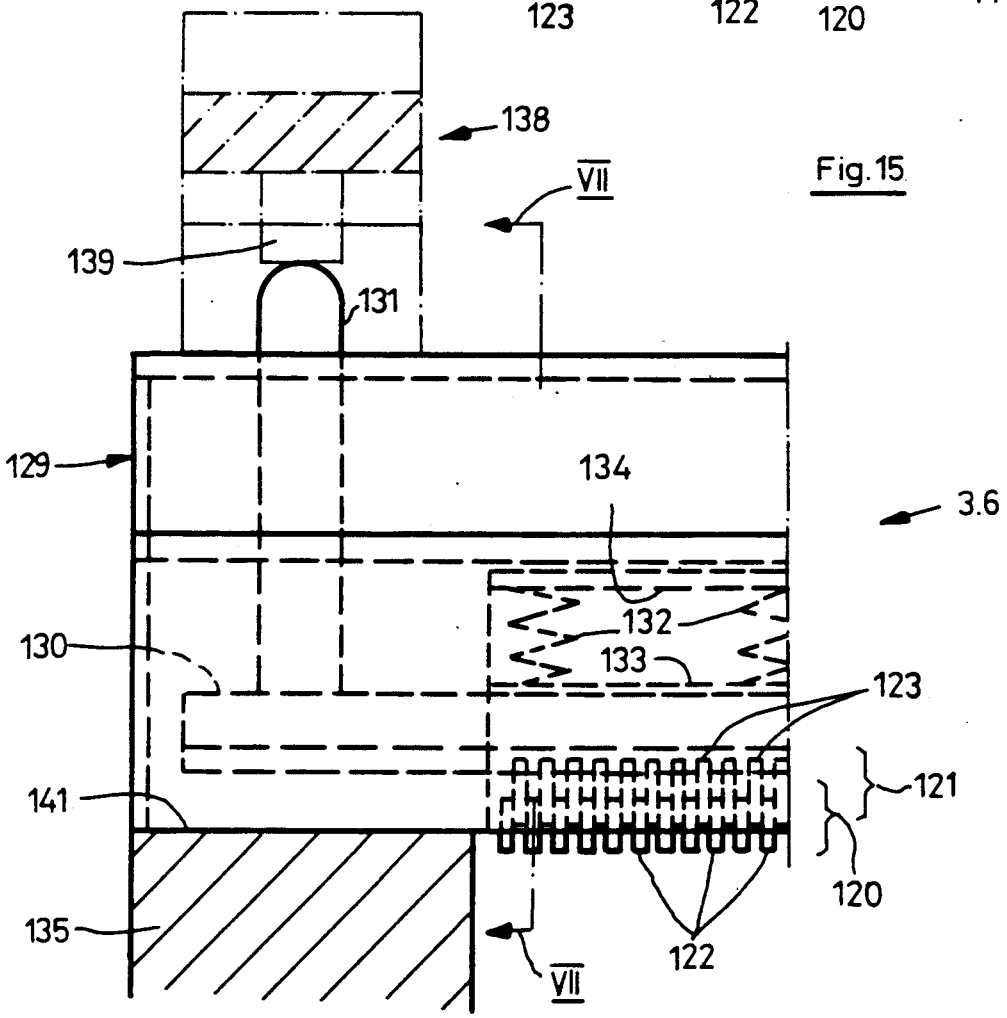
Fig. 15
138
VII
139
131
129
134
3.6
132
133
130
123
121
141
120
135
122
VII

ADJUSTABLE TEXTILE CARD ELEMENT AND METHOD OF USE

FIELD OF THE INVENTION

This invention relates to preparatory apparatus for use in cleaning and opening textile fibers prior to spinning. It is concerned particularly with means by which changes can be made conveniently in the fiber treatment action carried out by such machines as cards, so as to facilitate optimization of the treatments given to particular fiber stocks in preparing them for particular spinning operations. In general, the invention focuses on means by which changes can be made selectively in the toothed surface of a fiber worker element, such as a carding element, disposed in proximity to a card drum or the like, so as increase or decrease the severity or some other characteristic of the fiber working action achieved.

BACKGROUND

Various toothed devices have long been disposed to cooperate with toothed carriers to achieve fiber cleaning and carding functions. In carding machines, for example, the main card drum may rotate past fixed or movable worker elements (e.g. rollers or flats) that are themselves provided with teeth or the like. Such toothed surfaces will be referred to at times herein as clothing, and the worker elements which bear them will be referred to at times herein as carding elements. The nature and size and arrangement of the teeth in the clothing are factors which are known to affect the action on the fibers being treated.

In ordinary operations heretofore it has been usual practice to install a different carding element in a carding machine when it became desirable to change the action of the clothing on the fibers. This required substantial work in removing an existing carding element, and fixing a new one in a precisely adjusted position on the machine. In view of the expense and inconvenience of such changes, it has been usual practice to keep a particular clothing in operation for a considerable time.

With the present day trend in the automation of the operating functions in spinning mills, there is a need for the optimization of cleaning effectiveness depending on a processed intermediate product (e.g. a carded sliver) or an end product (e.g. a staple fiber yarn). This is affected also by the diversity found in the fiber stocks to be processed, and the amount of fiber degradation due to working (herein referred to as fiber detriment) which is permissible in the particular operations.

The assignee of the present invention has filed Swiss Application No. CH 1929-89/1 disclosing a method for optimizing the processing of cotton in a spinning mill with regard to throughput quantity, residual dirt content and fiber detriment of the processed product and/or of the intermediate product. The subject matter of such application is incorporated herein by reference. In the present application, devices for the execution of the method are proposed. The carding elements proposed here in the present invention result in further opportunities in the realization of the aforesaid method.

The method takes into account the conditions in present day spinning mills. In earlier spinning mills, the ring spinning process was used as the only process for the manufacture of staple yarns. However, new spinning processes have been developed, which make various demands on the cleaning effectiveness and the permitted fiber detriment in the cleaning of the cotton.

With the equipment available heretofore, it has been difficult to meet optimally the various requirements with regard to the variability of the throughput quantity, the residual dirt content and the permitted fiber detriment and their relationship with each other. Optimization of the degree of cleaning to be achieved in using the aforesaid method must take into account the various high demands made on the appropriate spinning process by the last two variables mentioned. Also to be taken into consideration in connection with this optimization is the fact that the fibers presented to a spinning mill may be made up of a mixture of fibers from different origins. A mixture of this type is again an optimization of the quality demands of the finished yarn and of the economical requirements taking into account the prices of the raw cotton and the yarn.

The characteristics of cotton fibers from different origins which are affected directly by the natural features are the fineness and length of the individual fibers as well as the strength, elongation and color of the individual fibers and are affected indirectly by the type and manner of the picking, the cleanliness and the amount of dirt in the raw cotton.

The types of dirt include very coarse impurities as well as to metal parts, string, material residues and other foreign elements. There may be coarse husk fragments of the cotton and, lately, very fine husk fragments, so-called "seed coat fragments" which cause a lot of trouble in the spinning mill.

Further, as a result of the very intensive processing of the cotton fibers, fiber detriment occurs which, above all, leads to a shortening of the fibers, but which however, can also lead to a deterioration of the strength and elongation.

It is clear that in an economical cleaning department of a spinning mill an optimization must be found which meets the wishes of the commercial side for the aforesaid high performance as well as meeting the wishes of the technological side for careful opening and cleaning of the fibers. The result of this optimization can differ according to the use of the cleaned fibers in one or another of the spinning processes.

SUMMARY OF THE INVENTION

The present invention provides a carding element which can be adjusted conveniently to change the toothed surface presented to the carding or cleaning drum so as to change the working action on the fibers being processed. In one embodiment for example, the carding element has multiple surfaces carrying different clothing, and any one of such surfaces can be brought selectively to an active working position relative to the carding drum to bring a desired clothing into operation. Other types or sizes of teeth on other surfaces bearing other clothing are brought to idle or inactive positions.

An important advantage attained through the invention is that the cleaning intensity can be suited to the requirements depending on the end product.

In the following, the invention is more closely explained on the basis of embodiments with the aid of representative drawings.

BRIEF DESCRIPTION OF THE DRAWINGS

FIG. 14 is a view partly in section along the section line VII—VII in FIG. 15 of a further carding element according to the invention.

FIG. 14*a* is a variant of a detail of the carding element from FIG. 14.

FIG. 15 is a view of a carding element similar to that of FIG. 14, but having an additional function.

DETAILED DESCRIPTION OF PREFERRED EMBODIMENTS

Figure 1:
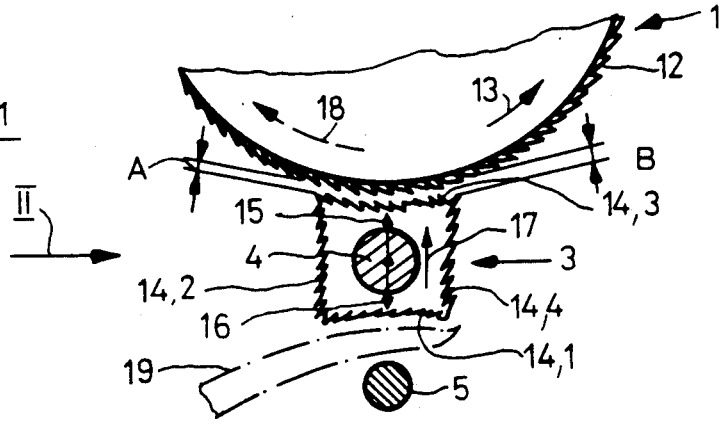
FIG. 1 is a cross-section along the section line I—I in FIG. 2 through a carding element according to the invention.
Figure 2:
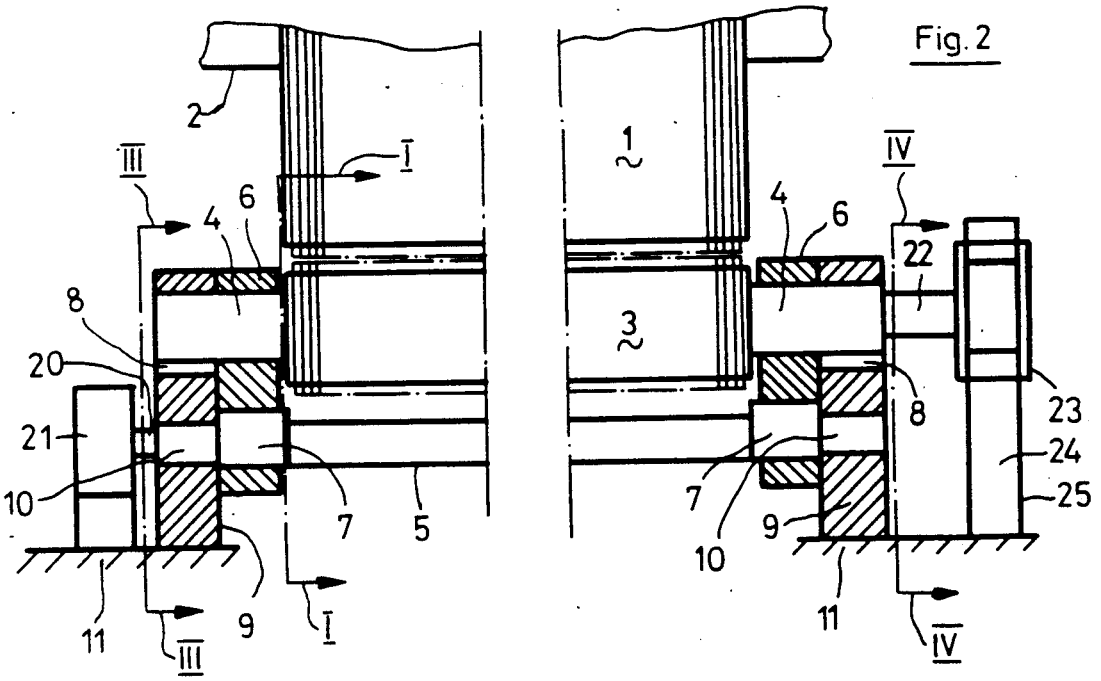
FIG. 2 is a partial longitudinal section of the carding element from FIG. 1 viewed in the direction II in FIG. 1.

FIGS. 1 and 2 show a carding or cleaning roller or drum 1 which may be driven in the direction of rotation 13. It is provided with clothing 12 and carries fibers (e.g., cotton fibers) past one or more workers. Such a worker is the carding element 3. It is of polygonal cross-section and is mounted adjacent the roller 1 by means of a shaft 4 which permits movement of the periphery of the element 3 about the axis of the shaft 4. As is the case with regard to all of the carding elements described herein, the carding element 3 in FIG. 1 extends over substantially the whole width of a card in the normal way.

The carding element 3 has a clothing on the four outer surfaces 14.1, 14.2, 14.3, 14.4. One of these, with its clothing 12, lies opposite to the periphery of the roller 1. The clothing 14.1 is the finest clothing, and each subsequent clothing is coarser than the preceding one, with the clothing 14.4 being the coarsest.

As explained later by means of FIG. 2, the carding element 3 is arranged to be movable in the direction of the arrows 15 and 16 relative to the roller 1 and pivots in the direction of the arrow 17. By reason of the movability of this element 3, any one of the four clothing elements with differing degrees of coarseness 14.1–14.4 can be put selectively into position to cooperate with the clothing 12 on the roller or drum 1. Through the optional alteration of the clothing selected as optimal at the start, it is possible to use an appropriate clothing of the carding element according to the requirements of cleaning effectiveness.

In FIG. 1, the clothing elements 12 and 14 are shown as toothed clothing. However, it is possible to use any suitable toothed or needle clothing. It is also unnecessary to arrange the clothing in such a way that the teeth are opposite to each other; the possibility exists of arranging at least one clothing in the other direction or all clothing elements may be arranged in such a way that the backs of the teeth are arranged against each other. In the latter case, the roller 1, for example, would turn in the direction of rotation 18.

FIG. 1 also indicates schematically that the clothing of the carding element 3 can be cleaned by means of a suction device 19 if desired.

In FIG. 2, exemplary means are shown for providing the possibility of moving the carding elements 3 in the directions 15 and 16 and the rotary direction 17. For this purpose, the shaft 4 is pivoted on both ends, each of which is in a bearing element 6. Each bearing element 6 is in turn pivoted on a cam 7 of an eccentric shaft 5 (see also FIG. 1). The cams 7 each have a stub shaft 10 which is pivoted in a bearing 9. These bearings 9 each have a guide slot 8, in which the two free ends of the shaft 4 are guided for the movement of the carding elements 3 in the directions 15 and 16.

In order to carry out these movements in the directions 15 and 16, a shaft extension 20 of the stub shaft 10 is connected with a servo-motor 21 which is able to rotate the eccentric shaft 5 or else hold it stationary, that is, to hold it in a specified position of the cam 7. The servo-motor 21 and the two bearings 9 are arranged to be stationary on the machine casing part 11.

In order to make the rotation of the carding element 3 in the direction of rotation 17 possible, the right hand end of the shaft 4 is connected by means of a shaft extension 22 to a further servo-motor 23 which is guided for the movement in the direction 15 and 16 between two slides 24 which are a part of the support 25. In the same way as the servo-motor 21, the supports 25 and the bearings 9 are arranged to be stationary on the machine casing part 11.

The servo-motor 23 serves for the rotation when desired of the element 3 by an amount sufficient to bring a selected type or size of clothing of the carding element 3 into position for operation on the fibers being processed by the drum 1.

The servo-motors 21 and 23 are represented purely schematically and need not necessarily be of the same form as shown. They can, for example, be geared motors with an epicyclic reduction gear and a shaft brake with a considerable reduction ratio, or the servo-motor 21 can be a spindle motor which drives or holds the shaft extension 20 stationary via a toothed rack and a gear wheel fitted on the shaft extension 20. Suitable servo-motors are usually geared motors with high gear ratios, which have an additional brake in order to hold the driven shaft in a specified position.

This rotation in the direction of rotation 17 makes it possible to alter the type or size of clothing presented on the carding element 3. Additionally, the possibility exists for maintaining an unequal clearance between the clothing elements 14.1 to 14.4 and the clothing 12 at the inlet and outlet in the direction of rotation of the roller 1. This means that the clearance A (FIG. 1) can be different from the clearance B, and the difference between these two clearances can be different from case to case and may be determined empirically.

Similarly with regard to the selection of the clothing to be used to meet particular requirements, the partnership between the clothing 12 and the different clothing elements 14.1 to 14.4, as well as the size of these clothing elements, may be determined empirically by experiment.

Figure 5:
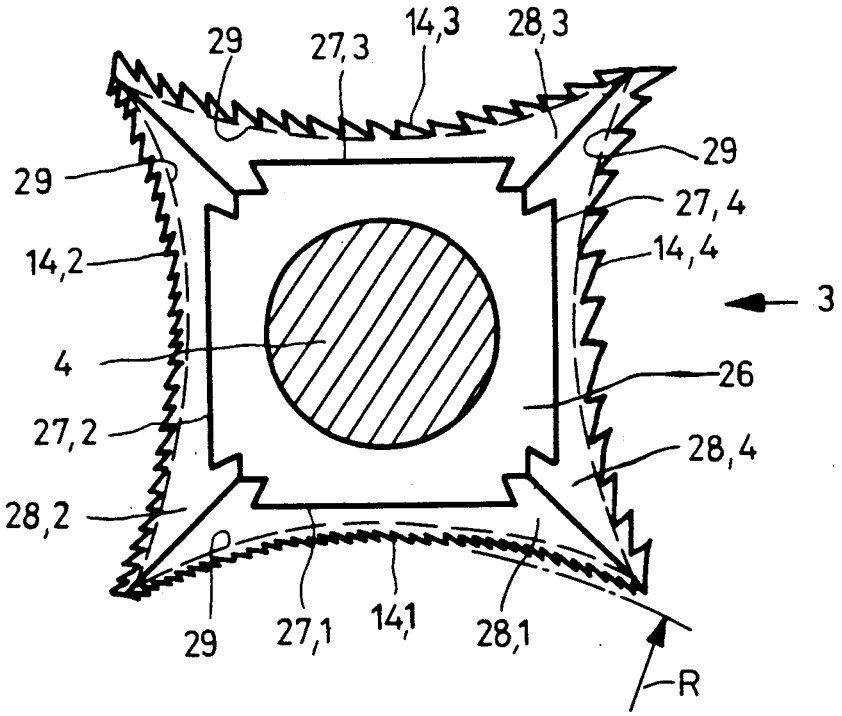
FIG. 5 is an enlarged and more detailed representation of the carding element of FIG. 1.
Figure 6:
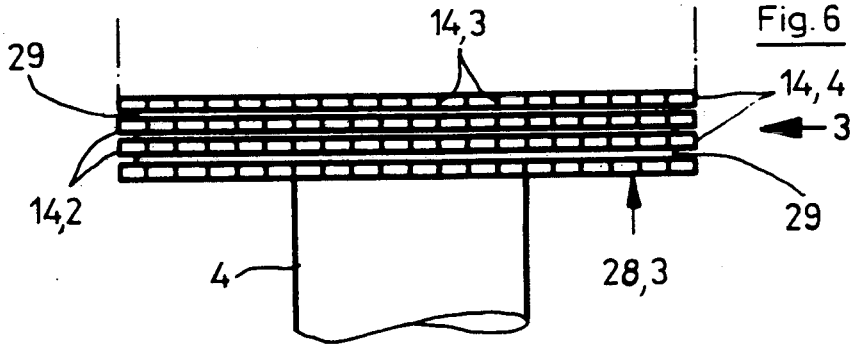
FIG. 6 is a partial top view of the carding element from FIG. 5.

FIGS. 5 and 6 show the details of the carding elements 3. A basic element 26 is permanently fitted on the shaft 4 and has four dovetail guides which are designated with the reference characters 27.1, 27.2, 27.3 and 27.4. The dovetail guides 27.1 hold the clothing laminations 28.1 with the clothing 14.1; the dovetail guides 27.2 hold the clothing laminations 28.2 with the clothing 14.2; the dovetail guides 27.3 hold the clothing laminations 28.3 with the clothing 14.3; and the dovetail guides 27.4 hold the clothing laminations 28.4 with the clothing 14.4.

It is shown in FIG. 6 that distance or spacer laminations 29 are provided between the clothing laminations in order to maintain a clearance between the individual clothing laminations. In FIG. 5, these distance laminations 29 are shown with a dotted line. It can be seen from this that the distance laminations 29, seen in the radial direction, reach to the roots of the teeth.

Figure 7:
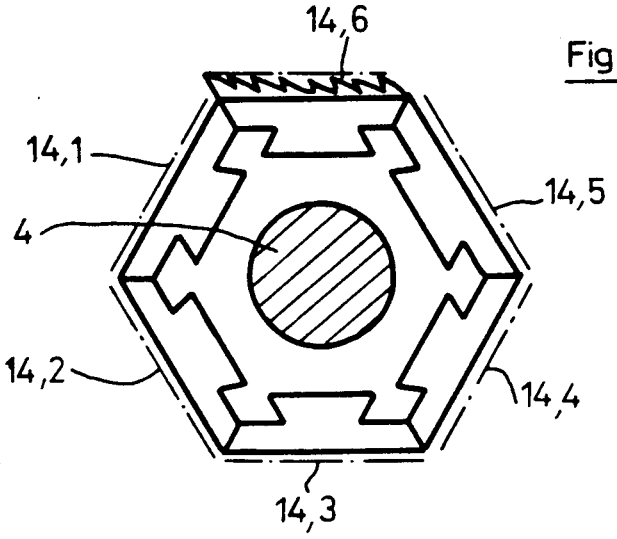
FIG. 7 is variant of the carding element from FIG. 5.

FIG. 7 shows a variant designated 3.1 of the carding element 3 of FIGS. 5 and 6. This variant has six surfaces in order to increase the number of different clothing elements or types. It is clear that this variant also can be given a concave curvature, as is schematically shown with a dash-dotted line in FIG. 5 and designated with the arrow R. As a rule, this curvature is selected to be concentric with the concave curvature of the clothing 12 of the roller 1.

Figure 8:
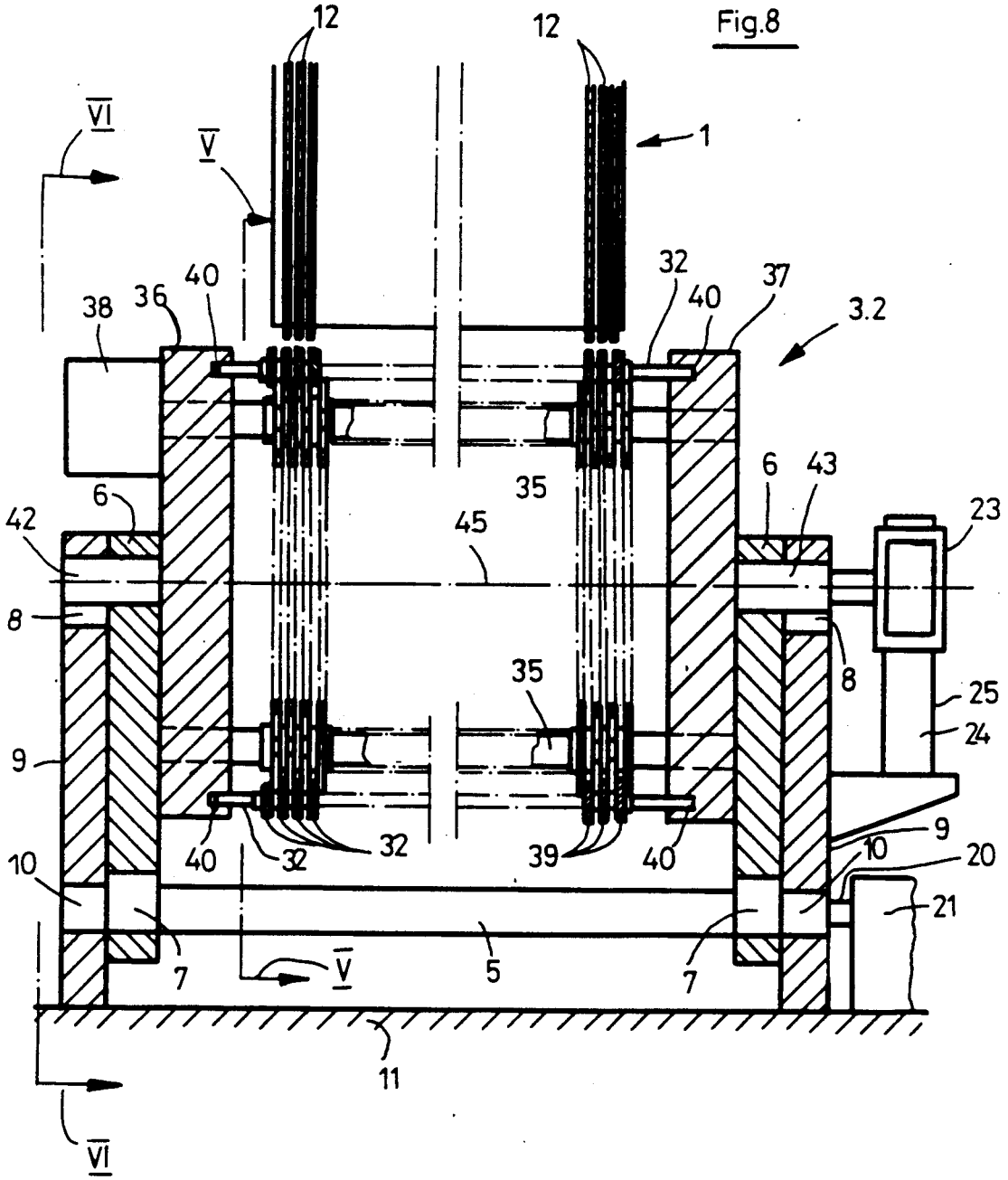
FIG. 8 is a partly schematic view showing another form of carding element according to the invention, such view being partly in section along the section line IX—IX in FIG. 10.
Figure 10:
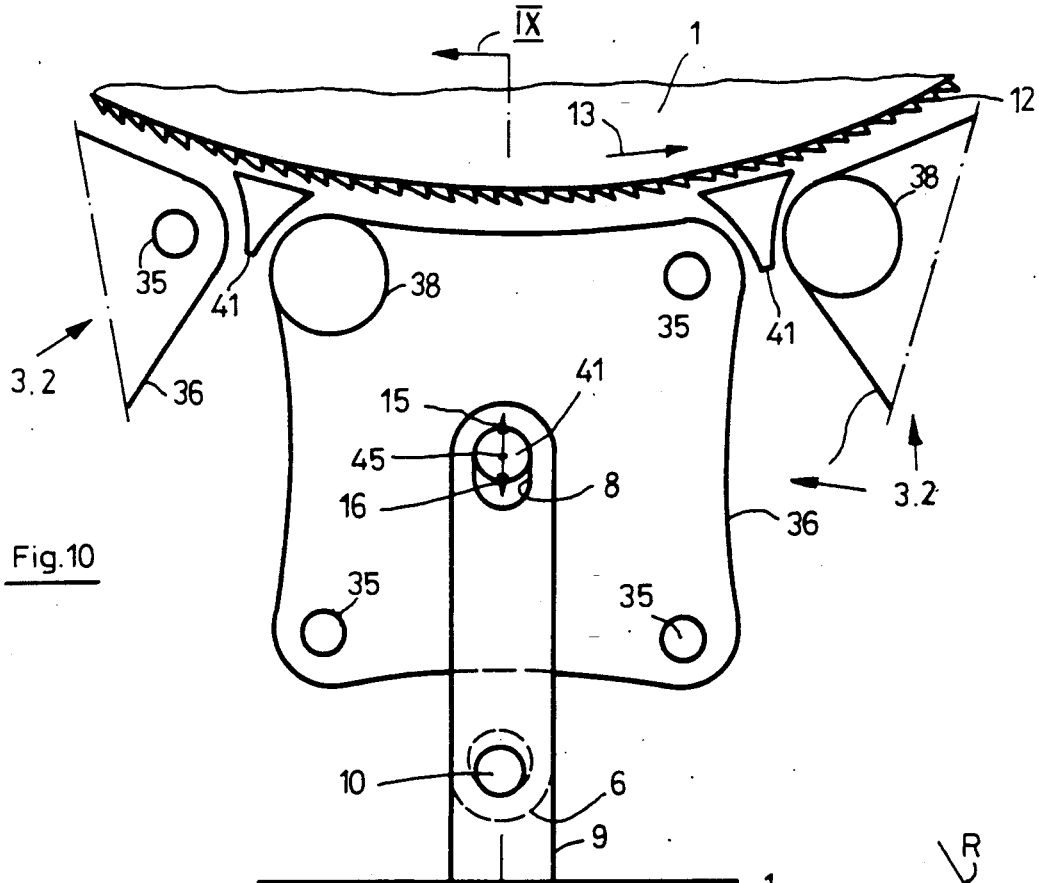
FIG. 10 is a view in the direction VI—VI of the carding element of FIG. 8.
Figure 9:
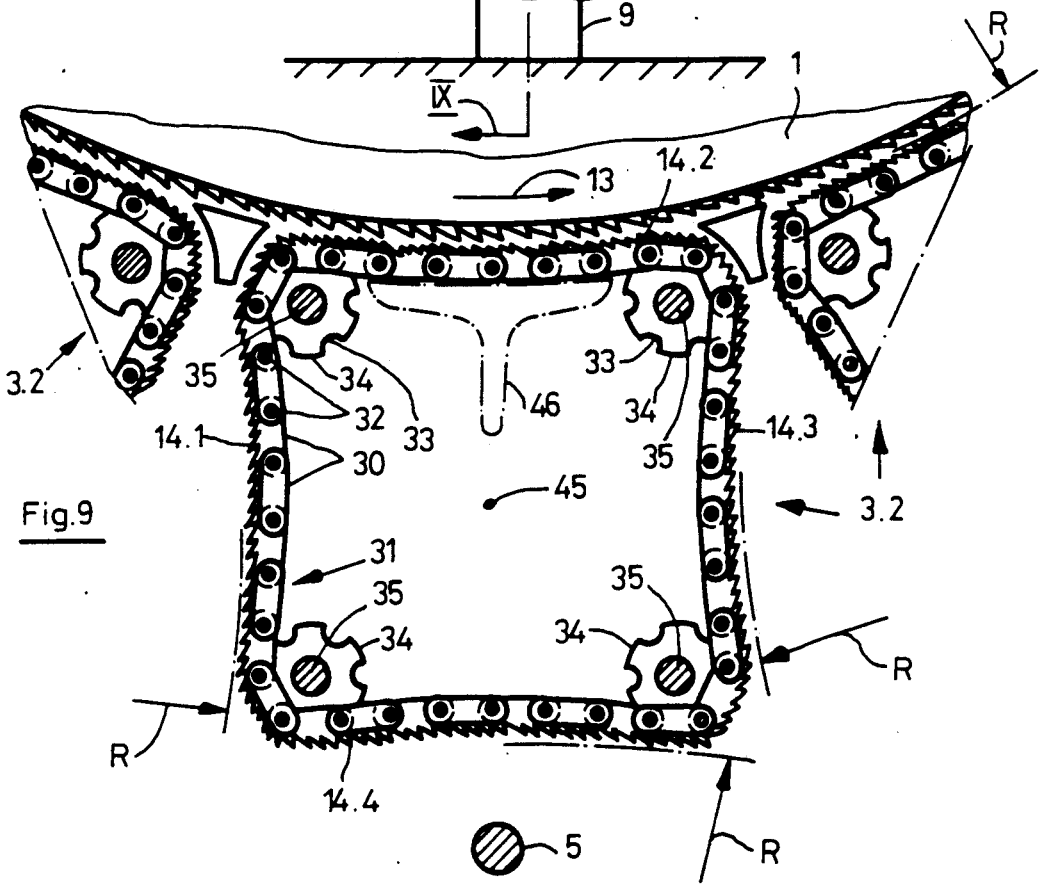
FIG. 9 is a section along the lines V—V through the carding element of FIG. 8.

FIGS. 8, 9 and 10 show another embodiment of carding element 3.2 in which the different clothing elements are not components of a permanently fitted clothing lamination, but are rather provided as parts of a chain 31. The clothing elements are, however, designated with the same reference symbols as in FIGS. 1 to 6, as this is a matter of the same types of clothing.

The chain links 30 form the chain 31 with the help of the throughgoing chain link bars 32 extending in the axial direction of the carding element 3.2. Tubular distance links are provided between the individual chains 31 and are likewise fitted to the link bars 32. These distance or spacer links are accommodated in the grooves 33 of the chain wheels 34, as is the case with a bicycle chain. The chain wheels 34 are fixed on a throughgoing shaft 35.

As can be seen from FIG. 9, four such shafts 35 are provided, each with a mutual specified clearance, and the sum of all the chains 31 forms the actual carding element 3.2. However, it can be that only two shafts 35 are provided, whereby only two different clothing elements will be provided.

The shafts 35 are pivoted at both ends in bearing plates 36 and 37, and one of the shafts is connected with a servo-motor 38. This servo-motor is represented purely schematically in FIGS. 8 and 10 and the explanation already given for FIG. 2 holds good. The rotation of the other three shafts, which are not separately driven by a servo-motor, is effected by means of the chains 31.

Further, the chain link bars 32, are each guided on their free ends in grooves 40 provided in the bearing plates 36 and 37. Each groove 40 is continuous so that the bars 32 may circulate therearound. Moreover, the grooves 40 are shaped in such a way that the chain forms the curvature with the radius R schematically represented with the dash-dotted line. This curvature, as shown in FIG. 9, remains the same for the clothing elements 14.1, 14.2, 14.3 respectively 14.4. This curvature with the radius R corresponds with a curvature concentric to the axis (not shown) of the roller 1, insofar as the clearance is the same between the clothing 12 of the roller 1 and the clothing in action on the carding element 3.2 is the same over the entire longitudinal section of the peripheral length of the clothing 12.

Further, guides 46 are provided for every section of the chain, though only one is shown in FIG. 9. These accommodate the pressure caused by the radial forces on the clothing which the link bars 32 support.

From FIGS. 9 and 10 it can be seen that more than one carding element 3.2 can be provided and that, before and after a carding element 3.2 (or between two carding elements 3.2), a fiber fleece guiding element 41 can be provided. It does not slide the fleece lying on the clothing 12 away between two carding elements 3.2, in spite of the centrifugal force acting on this fleece through the rotation of the roller 1, but rather guides the fleece to the next carding element.

The fact that more than one carding element can be provided round the periphery of the roller also holds good for the carding element 3 and 3.1 of FIGS. 1 and 7.

As can be seen in FIG. 10, it is possible to move every carding element 3.2 in the directions of movement 15 and 16, as well as in the direction of movement 17. The object of these two linear movements and the rotary movement is the same as for the carding elements 3 and 3.1, which is the reason why the same reference symbols have been used for these movements.

In order to achieve the two linear movements 15 and 16, the bearing plate 36 in FIG. 8 has an axle 42 and the bearing plate 37 has a shaft 43. Both the axle 42 and the shaft 43 are coaxial with the axis 45 of the bearing plates 36 and 37.

Figure 3:
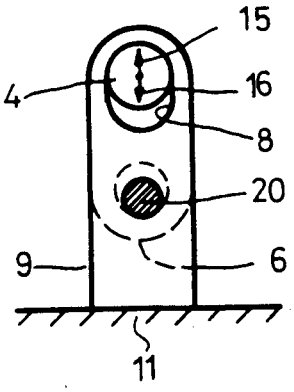
FIG. 3 is a section along the section line III—III in FIG. 2.
Figure 4:
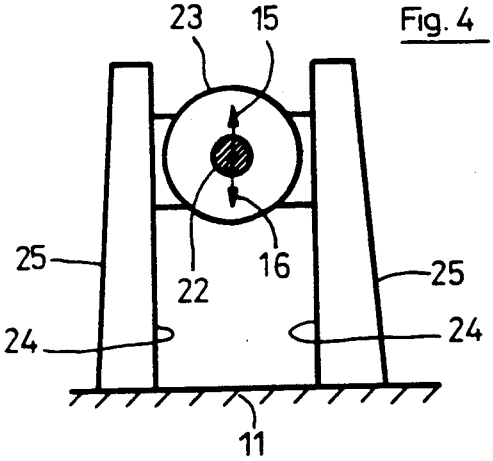
FIG. 4 is a section along the section line IV—IV in FIG. 2.

The means of realizing that these linear movements as well as the rotary movement 17 on the individual carding element 3.2 correspond substantially with the means drawn and described in connection with FIGS. 3–4, which is the reason why the same reference symbols are used, with the exception that it is the extension of 44 of the shaft 43 which is connected with the servo-motor 23.

Figure 11:
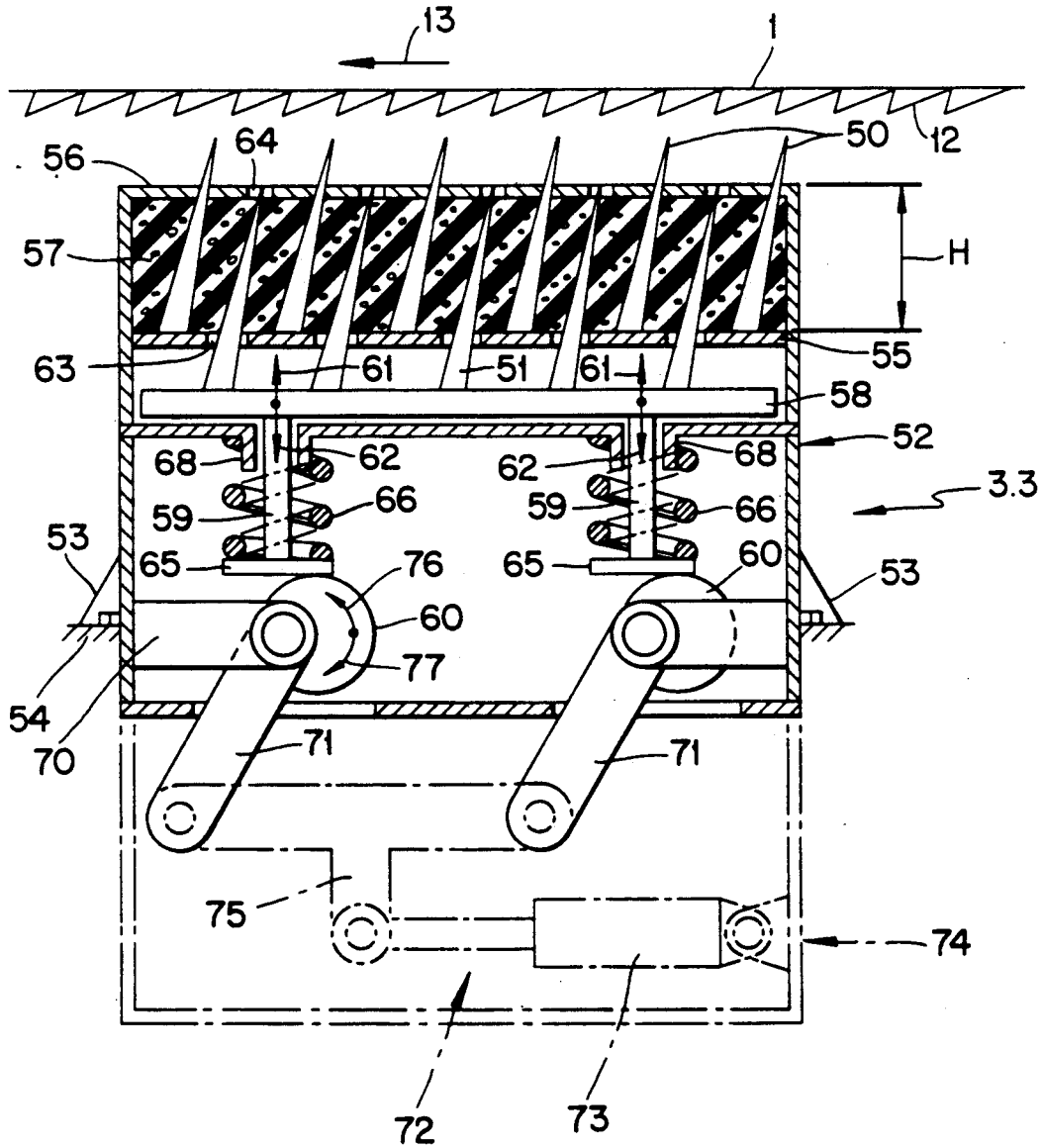
FIG. 11 is a view partly in cross-section showing schematically a further carding element according to the invention.

FIG. 11 shows a further carding element embodiment designated 3.3. Here, the carding or cleaning roller 1 is only represented through the clothing 12, which for reasons of simplicity, is represented as a straight line clothing.

The carding element 3.3 has a fixed needle clothing 50 and a movable needle clothing 51. Both of these clothing elements are arranged in a casing 52, which is fixed to a stationary machine part 54 by means of supports 53 and which extends over the width of the card in the longitudinal direction (not shown) and is shaped like a teasling bar, seen from outside.

The needles of the stationary clothing 50 are inserted in a base plate 55, which is provided within the casing 52 in such a way that the needles protrude from the casing 52 by a specified amount. It can be seen from FIG. 11, that between the upper wall 56 of the casing 52 and the ground plate 55, the needles of the clothing 50 are inserted in a foam rubber mat 57, which serves the purpose of filling the space between the upper casing wall and the base plate 55 so that dirt and dust cannot accumulate in this space.

The intermediate space filled with the foam rubber or other suitable material 57, taken with the selection of long conical needles, results in a possibility of varying the clearance H, not as a movable element but rather as an adjustable element. Through this, the points of the needles of the clothing 50 can protrude from the upper casing wall 56 by differing amounts.

The needles of the movable clothing 51 are inserted in a movable base plate 58, which, for its part, is provided with a plurality of tappets 59. These are movable by a rotating cam 60 in the directions of movement 61 and 62, so that points of the needles of the movable clothing 51 can protrude from the upper casing wall to a specified dimension. This dimension can correspond to the protrusion of the needle points of the fixed clothing 50 or may exceed or be less than this.

As a result of the inclined position of the needles of the movable clothing 51 and the vertical movement, as seen in FIG. 11, in the directions 61 and 62 of the base plate 58, there are openings 63 in the base plate 55 and openings 64 in the upper casing wall 56, through which the movable needles extend, which are large enough to avoid the movable needles coming against the walls of the openings 63 and 64 with the movements 61 and 62.

Further, the tappets 59 are fixed with a tappet plate 65. This tappet plate 65 serves on the one hand as an element which lies against the rotating cam 60 and converts the rotary movement of the cam 60 into the linear direction 61 and on the other hand, acts as a stop for a compression spring 66 between this tappet plate 65 and a partition 67 for causing the movement in the direction 62. The movement of the movable base plate 58 in the directions 61 and 62 is limited through the stationary base plate 55 and through the partition 67. The partition 67 has guide bushes 68 in addition which serve for the guidance of the tappets 59.

Each rotating cam 60 is a part of an eccentric shaft which pivots in a supporting element 70. The supporting elements 70 are, for their part, fixed on the appropriate walls of the casing 52. As a drive for the camshaft, a lever 71 is fixed to this shaft. The lever 71 can be swivelled either manually or mechanically by means of a swivel lever 72 (represented by a dash-dotted line) so that the cam 60 swivels in the directions of rotation 76 and 77.

The swivel drive 72 comprises a servo-motor 73 arranged to swivel on an extension 74 (shown with dash-dotted lines) of the casing 52 and connected with a swiveling power transmitting lever 75, which, for its part, is further connected for swiveling the lever 71. The swivel drive 72 can be additionally provided, which is the reason why this and the appropriate elements are represented with dash-dotted lines.

The two levers 71 should be moved substantially in synchronism, in order to prevent the needles of the movable clothing 51 coming into a different inclined position, in which they would be impeded in their movement through the openings 64 respectively 63, as a result of friction.

Figure 12:
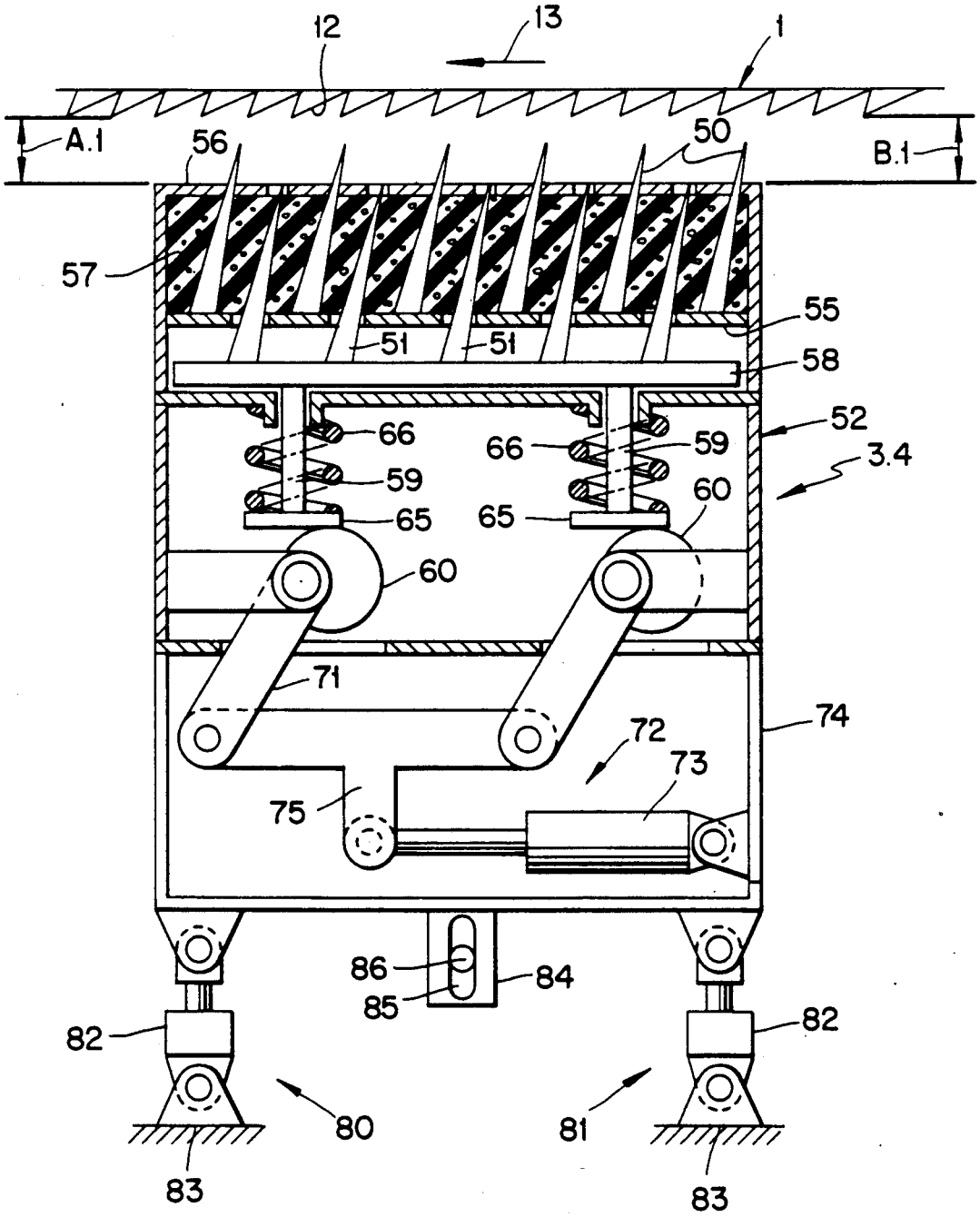
FIG. 12 is a similar view of a carding element like that in FIG. 11 but having additional functions.

FIG. 12 shows the carding element 3.4 of FIG. 11 arranged as movable or stationary by means of a drive 81 in such a way that the clearances A.1 and B.1 can be increased or reduced uniformly or maintained as different. For example, the clearance B.1 may be larger than the clearance A.1, so that an increased carding effect results.

As it is a matter of a so-called carding bar with the carding element 3.4, at least two servo drives 80 and 81 are necessary. These are placed on both ends of the bars. Each of the servo drives 80 and 81 comprise a servo-motor 82 arranged to swivel on a stationary machine part 83 and pivotally connected to a casing extension 74. Further, a guide element 84 is fixed to the casing extension 74 on both ends of the carding element. This directs a guide pin 86 in a guide slot 85 in such a way that no movement of the carding element 3.3 in the direction of movement of the clothing 12 results.

Figure 13:
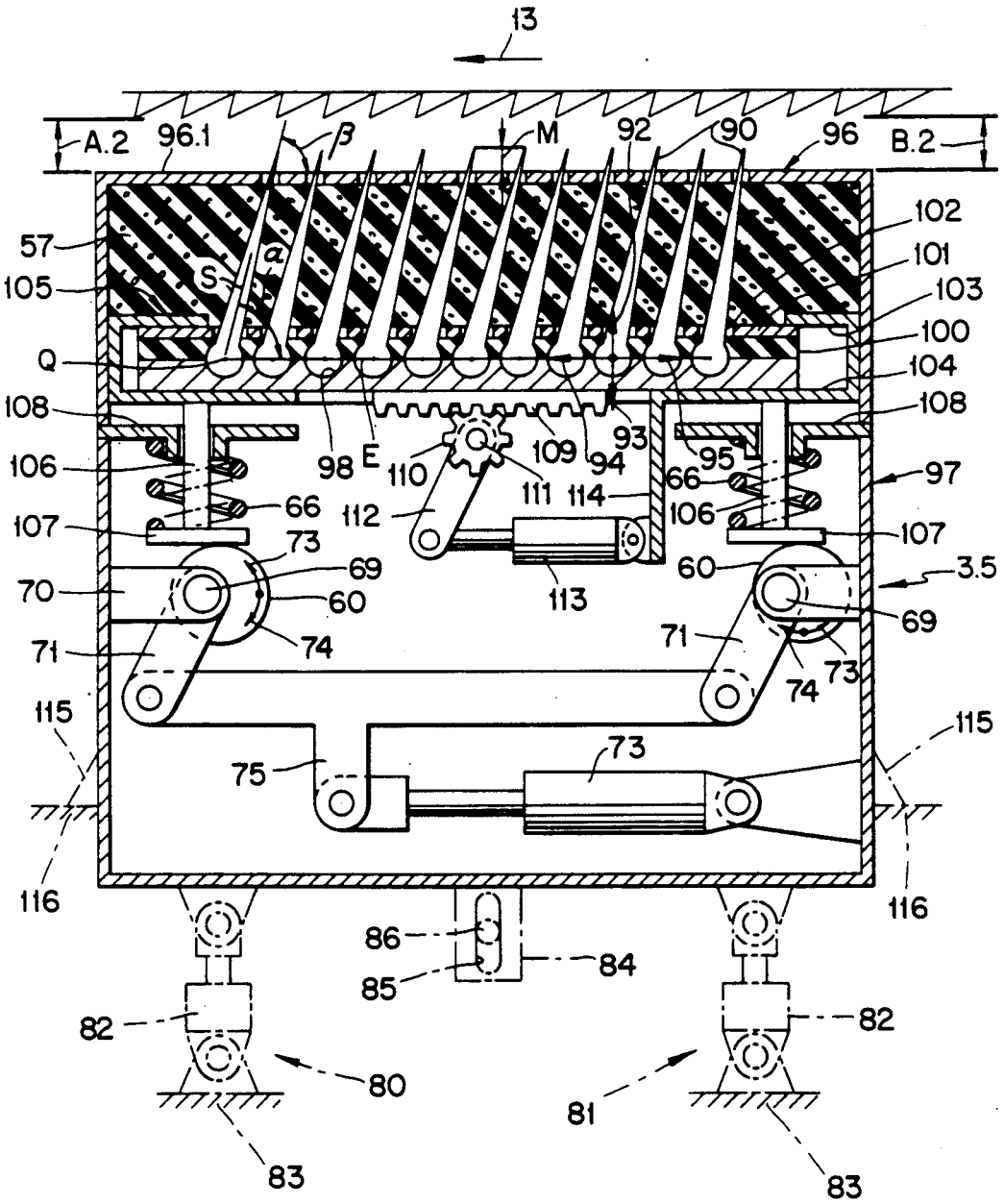
FIG. 13 is a view partly in section and showing half schematically a further carding element according to the invention.

FIG. 13 shows a further embodiment of the invention having a carding element 3.5 provided with a movable needle clothing 90. Every needle has a foot 91, which, through means which will be explained later, executes a linear up and down movement 92 and 93, as seen in FIG. 13, and a reciprocating movement 94 and 95, likewise as seen in FIG. 13.

The needle points of the clothing 90 protrude with a specified clearance M from an upper wall 96 of a casing which extends over the whole width of the card and is shaped like a teasling bar, seen from the outside.

Through the up and down movements 92 and 93 of the needle foot 91, an angle of incidence beta is formed between the front wall of each needle 90 and the surface 96.1 of the casing wall 96. An angle of inclination alpha, which is smaller or larger than 90 degrees, alters automatically with an alteration of the clearance M. The angle of inclination alpha about axis Q of the needle foot 91 is formed between a symmetric line S of the needle 90 and an imaginary plane E which contains the swivel angle Z.

With the additional reciprocating movements 94 and 95, and the simultaneous upwards and downwards movements 92 and 93, the possibility exists of altering the angle of incidence beta with the clearance remaining the same, or conversely, of altering the clearance M with the angle beta remaining the same.

In order to make this possible, the needle foot 91, has a spherical shape when using round needles, that is, conical needles and a disc form when using flat needles pressed out from sheet metal with a tapered needle shape.

Now, whether the foot 91 is formed as a sphere or as a disc, each needle foot is embedded in a longitudinal groove, when seen in the longitudinal direction of a carding element. These have a shape complementary to the needle foot and are a part of the base plate 99. The longitudinal direction of a carding element runs in the vertical direction to the surface as can be seen with the sheet designated as FIG. 13. This means that the base plate has as many longitudinal grooves arranged adjacent to and parallel with each other as needle feet are available in the transverse direction of the base plate.

The needle feet are covered with a foam rubber mat, in which the needles are effectively inserted in order to hold them in the grooves 98, as well as through a rigid plate 101. The plate 101 can, for example, be a metal plate or a stiff plastic plate. In any case, this plate 101 requires openings 102, in which the individual needles of the needle clothing 90 can move freely, in order to accommodate the various positions. It is not necessary to have an opening in the rubber mat 100 corresponding to the opening 102, as the rubber mat is resilient, so that the material adapts itself to the movement of the needles without substantial alterations or disturbances.

The base plate, the rubber mat 100 and the covering plate 101 together provide a composite unit with a specified thickness, which is movable on two guide surfaces 103 and 104 in the directions of movement 94 and 95. The guide surfaces 103 and 104 are parts of a movement element 105, for which tappets 106 are provided for the vertical movement in the directions of movement 92 and 93. The tappets are distributed over the length of the movement element 105 and a tappet plate 107 is fixed on the free end of each of them.

The complete unit functions in the same way as described for FIG. 11 which is why the further elements for the movement of the tappets are designated with the same reference symbols and are not further described. The same applies to the foam rubber mat 57 between the movement element 105 and the casing wall 96. A guide plate 108 is provided for each of tappets 106 as a component of the casing 97.

The base plate has a toothed rack 109 on each of its longitudinal ends. Each rack 109 is fixed to the base plate to move therewith in the directions of movement 94 and 95. A gear wheel 110 meshing with this toothed rack is fixed to a shaft 111. The shaft 111 is fixed to a swivel lever 112 pivotally connected on its free ends with a servo-motor 113 pivotally mounted on a support 114 carried by the movement element 105. The shaft 111 is likewise pivoted in supports (not shown) which are components of the movement element 105.

The clearance (not shown) between the two toothed racks is such that the drive force of each gear wheel is applied as far as possible in the end position, seen in the longitudinal direction of the base plate, this is, effective in the vertical direction to FIG. 13.

The casing 97 can either be immovably mounted through brackets 115 on stationary machine part 116 (as represented with dashed lines), or in the same way as shown in FIG. 12, be provided with the servo-motors 82 so that the clearances A.2 and B.2 are variably adjustable, as described for FIG. 12. The necessary elements for this are designated with the same reference symbols as for FIG. 12, as they function in the same way and with the same objective.

FIGS. 14 and 15 show a further carding element 3.6, which has a fixed toothed clothing 120 and a movable toothed clothing 121. The fixed clothing 120 consists of the individual clothing laminations 122 and the movable clothing is in the form of individual clothing laminations 123. The teeth of the toothed clothing 123 are in an idle or inactive position in FIG. 14 and are shown by a dotted line between the fixed clothing laminations 122.

The fixed clothing laminations 122 are fixed in a clamping unit 124 in such a way that intermediate spaces are available for the toothed clothing laminations. The clamping parts 124 are components of a guide part 125 which serves for the guidance of a carrier 126, which accommodates the movable clothing laminations 123 and is movable in the directions of movement 127 and 128, in order to move the movable clothing 121 into or out of its idle position. One working position is reached when the points of the movable toothed clothing laminations 123 protrude exactly as far as the points of the stationary toothed clothing laminations 122. The movable clothing also may be brought to an intermediate position in which the points of the teeth of the movable laminations 123 are between the two positions shown.

The guide parts 125 are fixed in a casing 129 which extends over the width of the card and, seen from outside, is shaped like a teasling bar.

In order to be able to move the carriers in the directions of movement 127 and 128, a tappet 131 is provided on one side of both the free ends 130 (only one being shown in FIG. 15 of the carrier 126). Each tappet 131 is fixed to the carrier 126 and protrudes from the casing 129. The carrier 126 is moved in the direction of movement 128 by this tappet.

For the counter-movement in the direction 127, compression springs 132 are provided left and right of the tappet 131, as seen in FIG. 14. These are prestressed between two supporting plates 133 and 134. The lower support plate 133 (as seen in FIG. 14) is a component of the guide part 125 and the upper supporting plate 134 is a component of the carrier 126. There should be at least one spring 132 on each side of each tappet 132, arranged as closely as possible to such tappet. It is, however, an advantage when more than the aforesaid two springs are provided per side.

As a variant, the toothed clothing laminations 123 of the movable clothing 121 can be replaced through toothless full laminations 144 (FIG. 14*a*), with which the effect of the fixed clothing 120 is reduced when necessary, up to the point where it can be substantially eliminated.

Figure 16:
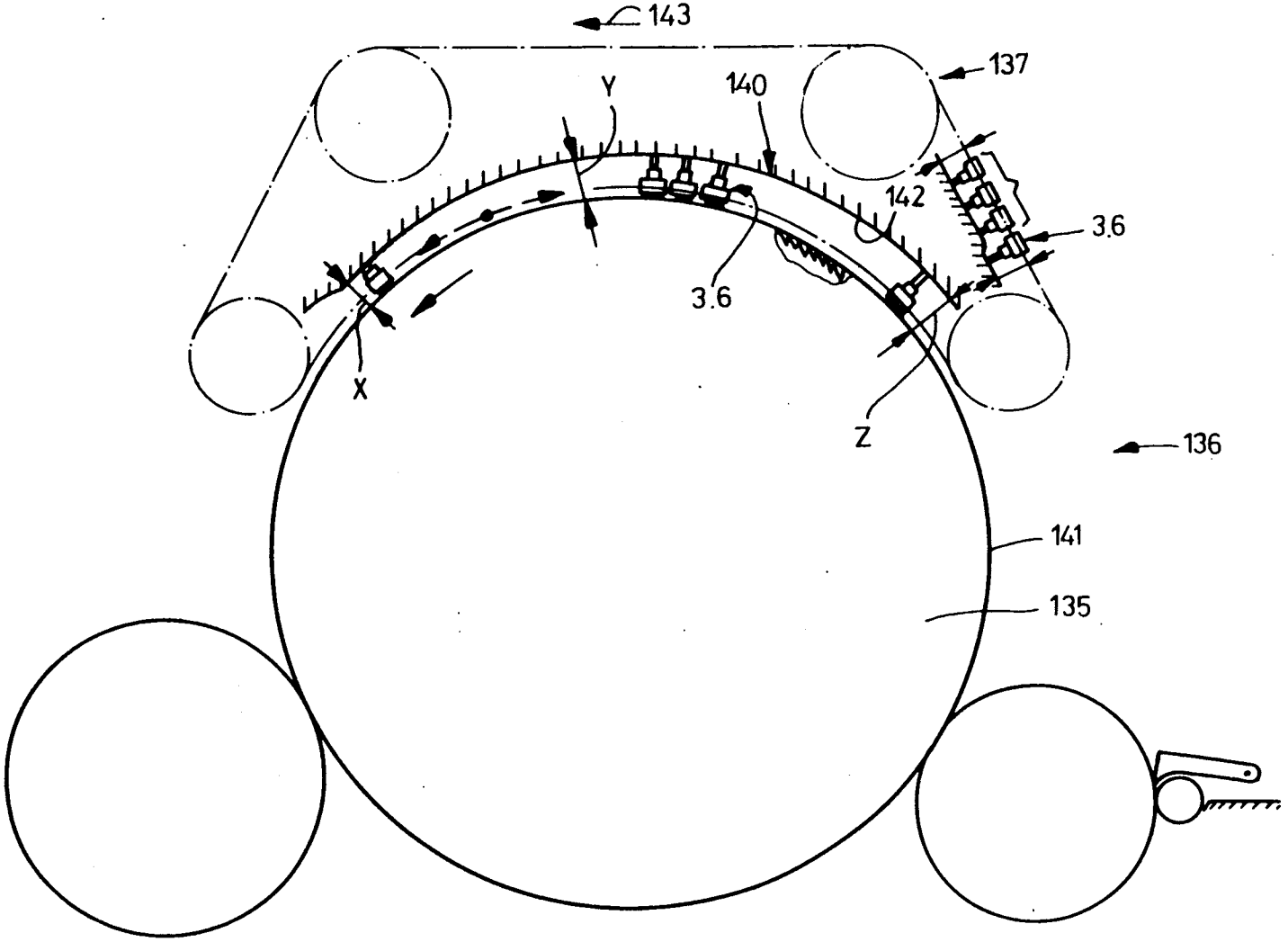
FIG. 16 is a side elevational view of a carding machine of the revolving flat type, showing schematically the application therein of a carding element according to the invention as shown in FIGS. 14 and 15.

It is represented schematically in FIG. 15 that the free ends of the casing 129 are each supported on a main cylinder shell 135 of a card 136 (FIG. 16), either as stationary clothing or as a component of a revolving flat 137, which is shown schematically in FIG. 16.

The special fastening of the casing 129 as a so-called stationary clothing bar or the fastening in a revolving flat is not a subject of this invention and is not further described for this reason. Substantially, it is possible, however, to develop the end parts of the casing 129 in such a way that this can be fastened in different ways to suit the cards from the appropriate card manufacturers.

For the movement of the tappet 131, a cylinder-piston unit 138 is fastened to the casing 129. This is represented purely schematically with a dash-dotted line showing a piston rod 139 which moves the tappet 131 in the direction of movement 128. The actuation of the cylinder piston unit 138 is effected by means of a control unit, as described in the Swiss patent application No. 1929-89/1, the disclosure of which is incorporated herein by reference.

When using a clothing according to FIG. 14 and 15 in a revolving flat of a card 136 (FIG. 16), a switching line 140 is provided for the actuation of the tappets 131 on the free ends of the clothing as a substitute for the cylinder piston unit 138.

Given a direction of movement 143 for the revolving flat, the actuation of the tappet 131 through the switching line 141 is effected in the following manner. The clearance between the peripheral surface 141 of the main cylinder shell 135 and the sliding surface 142 of the switching line 140 is such that, with clearance X at the start, the movable toothed clothing 123 is in one position relative to the stationary clothing to control the coaction achieved with the clothing on the card drum 135. Clearances Y and Z farther along in the direction of movement of the revolving flat 137 may be the same or different from the clearance X. For example, the clearance X may correspond to the inactive position of the movable clothing, clearance Y may correspond to an intermediate working position, and clearance Z may correspond to working position in which the points of the stationary lie at the same height as the points of the movable clothing. With this arrangement the movable clothing is moved increasingly in the direction of movement 128 as the flat on which it is mounting moves around the surface of the card drum 135 in a direction opposite to the direction of travel of the card drum surface.

Still other means than the stationary switching line 140 can be provided if desired to provide for control over the position of the movable clothing relative to the fixed clothing so as to alter as desired the carding effects exerted by the equipment.

What is claimed is:

1. Carding element (3 to 3.6) with a needle or toothed clothing (12) arranged on at least a part of the periphery around a carding roller (1) and extending over the whole width of a card, said carding element having a clothing which is stepwise movable, whereby each step corresponds to a specific type and/or specific size of clothing.

2. Carding element according to claim 1, wherein the clothing is stepwise movable in such a way that only one type or size of clothing can be brought into a working position at a time while clothing of a different type or size is placed in a position of rest, wherein means are provided for moving the clothing out of rest position into the working position and again into the rest position.

3. Carding element according to claim 2, wherein the carding element (3, 3.1, FIGS. 1 to 7) is a drum with a polygonal cross-section having lateral surfaces formed by clothing elements (14.1 to 14.6) which are different from surface to surface, the points of the clothing for each lateral surface lying in an imaginary single lateral surface having such a concave curve that, when a clothing is in a working position wherein all the clothing points have the same clearance (A, B) with respect to the surface of the roller, said imaginary surface is substantially concentric with the roller surface.

4. Carding element according to claim 3, wherein the carding element (3 to 3.6) can be rotated into other positions relative to the carding roller (1) and can be held fixed in specified positions.

5. Carding element according to claim 3, wherein the carding element can be moved to and fro into other positions relative to the carding roller and can be held fixed in specified positions.

6. Carding element according to claim 1, wherein there is a clearance between said clothing and said carding roller and wherein said clearance can be altered.

7. Method for the use of the carding element according to claim 1, wherein said clothing on the individual carding element can be moved when said carding roller is in operation.

8. Carding element with a needle or toothed clothing (12) arranged on at least a part of the periphery of a carding roller (1) and extending over the whole width of a card, said carding element (3 to 3.6) having more than one category of clothing and being movable optionally in such a way that one category of clothing can be brought into a working position while clothing of a different category is placed in a position of rest, said carding element including a plurality of endless chains (31) arranged parallel next to each other and being provided with needle or toothed clothing elements (14.1 to 14.4); at least two chain wheels (34) commonly supported for rotation in bearing plates (36, 37) parallel to each other and with a predetermined clearance for the accommodation of the chains (31) so that the clothing elements (14.1 to 14.4) in the area between the two chain wheels (31) are the same; said chains (31) being conveyed by guidance means (32, 40) in such a way that an imaginary surface connecting the points of the clothing elements has such a concave curve that, when a clothing (14.1 to 14.4) is in a working position wherein all the clothing points have the same clearance (A, B) with respect to the surface of the roller, said imaginary surface is substantially concentric with the surface of the roller (1).

9. Carding element according to claim 8, including four of said chain wheels.

10. Apparatus for preparing textile fibers for spinning comprising at least one fiber working unit having fiber contacting elements across the width thereof, and a main carrier having projecting elements for engaging textile fibers and moving said fibers relative to said working unit, said working unit having a width substantially across said main carrier width and including means operable to position at different times differing arrays of said fiber contacting elements to an area adjacent said main carrier when desired to alter the fiber treatment conditions carried out by the apparatus.

11. Apparatus according to claim 10, wherein said working unit includes a casing (52, 129) shaped like a teasling bar, movable clothing elements carried by said casing and being movable from a position of rest into the working position, and fixed clothing elements carried by said casing and being permanently in a working position.

12. Apparatus according to claim 11, wherein said main carrier is a carding roller, said apparatus including means (80, 81; 142) for positioning said casing (52, 97; 129) relative to said carding roller (1) in such a way that the clearance (A, B) between the casing and the carding roller (1) is not the same over the whole width of the carding element.

13. Apparatus according to claim 11, wherein said fixed clothing elements and said movable clothing elements are fitted with needles.

14. Apparatus according to claim 11, wherein said fixed clothing elements and said movable clothing elements include toothed laminations (144).

15. Apparatus according to claim 10, wherein said main carrier is a carding roller having clothing thereon, wherein said fiber working unit is a carding element adjacent a portion of the periphery of said carding roller, said carding element being a body of polygonal cross-section having clothing elements n plural faces thereof with the clothing elements on at least one of the faces providing an array of fiber contacting elements different from the array of fiber contacting elements provided by the clothing elements on another of said faces.

16. Apparatus according to claim 10, wherein said main carrier is a carding roller having clothing thereon, wherein said fiber working unit is a carding element adjacent a portion of the periphery of said carding roller, said carding element including chain means carrying different clothing elements thereon at different locations along the length thereof with the clothing elements on at least one portion of the length of said chain means providing an array of fiber contacting elements different from the array of fiber contacting elements provided by the clothing elements on another portion of the length of said chain means, said chain means being supported for lengthwise movement through a path having a length in proximity to said portion of the periphery of said carding roller.

17. Apparatus according to claim 10, wherein said main carrier is a carding roller having clothing thereon, wherein said fiber working unit is a carding element adjacent a portion of the periphery of said carding roller, said carding element including needles having tip portions movable toward and away from the periphery of said carding roller to form different arrays of fiber contacting elements.

18. Apparatus according to claim 10, wherein said main carrier is a carding roller having clothing thereon, wherein said fiber working unit is a carding element adjacent a portion of the periphery of said carding roller, said carding element including first and second sets of clothing elements arranged with elements of said second set located between elements of said first set, said first set of clothing elements being fixed in a position adjacent said portion of the periphery of the carding roller to present a first array of fiber contacting elements, and said second set of clothing elements having a withdrawn position in which they do not affect said first array but being movable toward the periphery of said carding roller to form with said first set of clothing elements a second array of fiber contacting elements different from said first array.

19. Carding element with a needle or toothed clothing (12) arranged on at least a part of the periphery of a carding roller (1) and extending over the whole width of a card, said carding element (3 to 3.6) having more than one category of clothing and being movable optionally in such a way that one category of clothing can be brought into a working position while clothing of a different category is placed in a position of rest, said carding element (3.5, FIG. 13) including a casing (97) shaped like a teasling bar and containing a clothing (90) composed of single needles each having a foot part (91) movable to and fro as well as upwards and downwards, seen with reference to the cross-section of the carding element, and means for moving the needle feet (91).

20. Carding element according to claim 19, including means (80, 81; 142) for positioning said casing (52, 97; 129) opposite said carding roller (1) in such a way that the clearance (A, B) between the casing and the carding roller (1) is not the same over the whole width of the carding element.

21. Fiber preparation apparatus adjustable to alter the fiber treatment carried out thereby, said apparatus comprising a rotatable roll having fiber engaging teeth protruding from the periphery thereof; fiber working means adjacent said roll; and means for adjusting said fiber working means relative to said roll so that different ones of a plurality of portions thereof may selectively be positioned in facing relation to the periphery of said roll; each of said portions of said fiber working means having working teeth thereon for coacting with said fiber engaging teeth protruding from the periphery of said roll to work the fibers, with the coaction between the working teeth on one of said portions and said fiber engaging teeth being different from the coaction between the working teeth on another of said portions and said fiber engaging teeth.

22. Fiber preparation apparatus according to claim 21, wherein said fiber working means includes a body of polygonal cross-section having clothing elements on plural faces thereof with the clothing elements on at least one of the faces providing an array of working teeth different from the array of working teeth provided by the clothing elements on another of said faces.

23. Fiber preparation apparatus according to claim 21, wherein said fiber working means includes chain means carrying different clothing elements thereon at different locations along the length thereof with the clothing elements on at least one portion of the length of said chain means providing an array of working teeth different from the array of working teeth provided by the clothing elements on another portion of the length of said chain means, said chain means being supported for lengthwise movement through a path having a portion in proximity to a portion of the periphery of said roll.

* * * * *